US007837190B2

(12) United States Patent
Feygelman et al.

(10) Patent No.: US 7,837,190 B2
(45) Date of Patent: Nov. 23, 2010

(54) STRIKE PLATE AND EXIT SECTION UTILIZING SAME

(75) Inventors: Alex Feygelman, Rehovot (IL); Elias Solomovitch, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 916 days.

(21) Appl. No.: 10/554,835

(22) PCT Filed: Apr. 30, 2003

(86) PCT No.: PCT/IL03/00350

§ 371 (c)(1), (2), (4) Date: Sep. 26, 2006

(87) PCT Pub. No.: WO2004/096685

PCT Pub. Date: Nov. 11, 2004

(65) Prior Publication Data

US 2007/0057440 A1 Mar. 15, 2007

(51) Int. Cl.
*B65H 31/26* (2006.01)

(52) U.S. Cl. ..... 271/220

(58) Field of Classification Search ..... 271/207, 271/182

See application file for complete search history.

(56) References Cited

U.S. PATENT DOCUMENTS

| | | | | |
|---|---|---|---|---|
| 4,667,949 | A | 5/1987 | Goodwin et al. | |
| 5,676,361 | A * | 10/1997 | Garbe | 271/3.04 |
| 6,073,925 | A * | 6/2000 | Sato | 271/171 |

FOREIGN PATENT DOCUMENTS

| | | |
|---|---|---|
| EP | 0 496 627 | 7/1992 |
| EP | 1 016 611 A | 7/2000 |
| JP | 59-108758 | 7/1984 |
| JP | 61-34368 | 7/1986 |
| JP | 63-100456 | 6/1988 |
| JP | 05-270717 | 10/1993 |
| JP | 05-310359 | 11/1993 |
| JP | 07-061683 | 3/1995 |
| JP | 09-124217 | 5/1997 |
| JP | 11-079525 | 3/1999 |
| JP | 2000-086059 | 3/2000 |

* cited by examiner

*Primary Examiner*—Saúl J Rodriguez
*Assistant Examiner*—Thomas A Morrison

(57) ABSTRACT

A strike plate (266) against which sheets (150) exiting a printer contact prior to falling into a receiving tray, the strike plate comprising: a) at least one strike face (268); and b) a generally outward directed abutment surface (254) at an upper portion of the strike face, said direction being referenced to said strike face.

21 Claims, 3 Drawing Sheets

STRIKE PLATE AND EXIT SECTION UTILIZING SAME

CROSS-REFERENCE TO RELATED APPLICATIONS

This application incorporates by this reference all subject matter contained in PCT Patent Application Serial No. PCT/IL2003/000350, as filed on 30 Apr. 2003, and entitled "Strike Plate and Exit Section Utilizing Same". This PCT application was published on 11 Nov. 2004 as International Publication No. WO 2004/096685 A1.

FIELD OF THE INVENTION

The field of the invention relates to strike plates that printed sheets contact after exiting a printer or copying machine seriatim so the sheets properly align in a sheet receiving tray.

BACKGROUND OF THE INVENTION

A printer or copier typically has a strike plate that a leading edge of a printed sheet contacts as it exits the printing machine, thereby halting the forward momentum of the sheet and aligning the sheet so that it falls, properly aligned, into a receiving tray.

FIGS. 1A and 1B are schematic rendition of an exit section 100 of a printer or other device (not shown). After printing is completed, a printed sheet 150 moves in a direction 152 and a leading edge 170 contacts a strike plate 180. Strike plate 180 serves to stop further motion of sheet 150 in direction 152 and align sheet 150 so that it falls flat into a stack of printed sheets 140 and/or sheet a receiving tray 102.

When a sheet 150 hits plate 180, ideally, the sheet should fall onto a tray 102, completely aligned in both the forward and cross directions. Since sheets may not fall directly on each other in the tray a surface 160 may be used to straighten the substrates and place them against a front surface of the tray. Similar mechanisms may be employed to align the sheets in the cross direction.

However, when sheets 150 hit strike plate 180 they may not just stop and fall into place. Often, especially with light weight sheets, the sheets will curl down (FIG. 1A) or up (FIG. 1B). If the curl is large enough, the jogging will not be sufficient to both straighten and align the sheet and the sheet.

U.S. Pat. No. 4,667,949 shows an angled strike plate at a trailing edge of the sheet. The object of this plate is to force the trailing edge of a sheet toward the pile of sheets as it ricochets from strike plate 180.

SUMMARY OF THE INVENTION

An aspect of some embodiments of the invention concerns providing an exit tray with a strike plate against which a sheet impinges, to stop forward motion of the sheet. In order to avoid curling of sheets hitting the plate, the plate has a substantially outwardly abutting, optionally substantially horizontal, surface at its upper edge, extending in a direction opposite to said forward motion. A sheet which curls upward will abut this edge and curling will be discouraged, so that it falls in a substantially flat configuration. Optionally any suitable abutment surface can be provided at the upper edge.

Alternatively or additionally, the plate has a substantially inwardly recessed surface at its lower edge, extending in the same direction as said forward motion. A sheet that curls downward will reach the end of the strike plate and, meeting no resistance, will no longer be encouraged by the strike plate to curl. This will encourage the sheet to fall in a substantially flat configuration.

Optionally, the strike plate forms a small angle with the vertical. Alternatively, the strike plate is vertical. Optionally, the angle of the strike plate is adjustable.

In some embodiments of the invention the strike plate is comprised of multiple strike steps, with each step offset along said motion direction of the paper with respect to a step above it. Thus, each strike step is situated between an inwardly recessed lower surface (the transition to the strike step below) and an outward facing upper surface (the transition to the strike step above). Thus, no matter which step the sheet strikes, upward or downward curling will be reduced.

In some embodiments of the invention, the surface of the strike steps is situated at an angle to the vertical. In particular, the present inventors have found that providing a front surface that is further recessed at its lower edge than at its upper edge by a small angle of under 15 degrees provides fewer fold-overs of the sheets, since it appears that very light papers have a tendency to ride upward (as shown in FIG. 1B).

In an embodiment of the invention the angle of the strike face of strike plate or the strike steps can be varied. This could be useful, for example, when printer handles different types of substrate. Since the optimum angle for the strike plate appears to depend on one or more of the weight and stiffness of the substrate, such optimization could reduce fold-over and jams in the system.

There is thus provided, in accordance with an embodiment of the invention, a strike plate against which sheets exiting a printer contact prior to falling into a receiving tray, the strike plate comprising:

a) at least one strike face; and b) a generally outward directed abutment surface at an upper portion of the strike face, said direction being referenced to said strike face.

Optionally, the strike face is formed with an outwardly directed surface along its upper edge, said surface comprising the abutment surface.

Optionally, a lower edge of the strike face is not formed with an outward directed abutment face. Optionally, the lower edge of the strike face is formed with an inwardly directed surface.

In an embodiment of the invention, the strike face is substantially vertical. Alternatively, the strike face is at an angle of between −5 and +15 degrees with the vertical, where a positive angle denotes that the normal to the strike face is rotated downward with respect to the horizontal. Optionally, the strike face is at an angle of between +5 and +15 degrees. Optionally, the strike face is at an angle of about +10 degrees.

In an embodiment of the invention, the strike plate includes a plurality of strike faces that are offset from each other in the direction of motion of the sheet.

There is further provided, in accordance with an embodiment of the invention, a strike plate against which sheets exiting a printer contact prior to falling into a receiving tray, the strike plate comprising:

a plurality of strike faces that are offset from each other in the direction of motion of the sheet.

Optionally, a lower surface associated with one strike face forms an upper surface of a next lower strike face.

Optionally, the strike plate includes a rotator, operative to rotate the strike face so as to allow for a different angle with respect to the vertical, depending on the characteristics of the sheet used.

Optionally, the strike plate is the surface of a cylindrical portion of an object. Optionally, the cylindrical object is rotated about the axis of the cylindrical portion with respect to the vertical. Optionally, the cylindrical portion has a diameter of between 20 and 30 mm. Optionally, the cylindrical portion has a diameter of about 24 mm.

There is further provided, in accordance with an embodiment of the invention, an exit receptacle and a strike plate according to an embodiment of the invention.

There is further provided, in accordance with an embodiment of the invention, a paper handling system comprising an exit section according to an embodiment of the invention.

There is further provided, in accordance with an embodiment of the invention, an imager comprising:

an imaging section; and an exit section according to an embodiment of the invention.

Optionally, the imaging section is a printer.

Optionally, the imaging section is a copier.

BRIEF DESCRIPTION OF THE DRAWINGS

Exemplary non-limiting embodiments of the invention are described in the following description, read with reference to the figures attached hereto. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. The attached figures are.

DETAILED DESCRIPTION OF EXEMPLARY EMBODIMENTS

Figure 2:
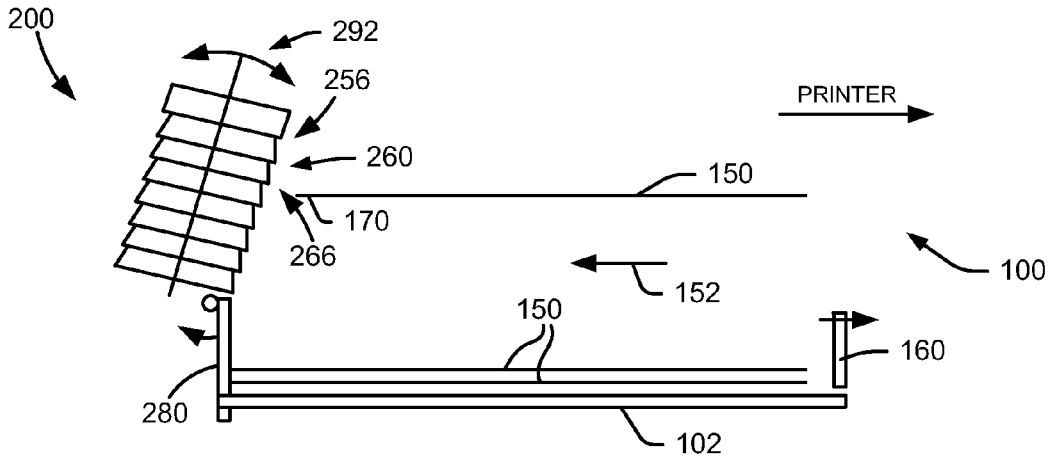
FIG. 2 is a schematic side view of an exit section of a printer comprising a strike plate having multiple strike steps, according to an exemplary embodiment of the present invention.
Figure 3:
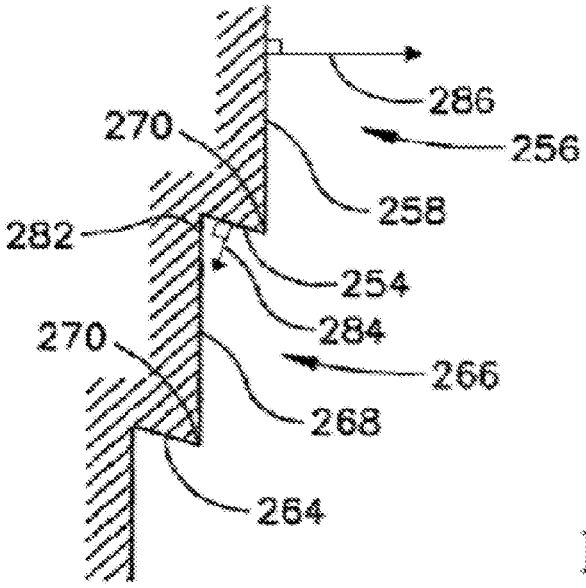
FIG. 3 is an enlarged schematic cross-sectional side view of a portion of the strike plate of FIG. 2; according to an exemplary embodiment of the present invention.

FIGS. 2 and 3 are schematic side views of a strike plate 200 associated with an exit section 100, having multiple strike steps including strike steps 256 and 266. Upper strike step 256 comprises a strike face 258 and lower strike step 266 comprises strike face 268.

In an exemplary embodiment, a leading edge 170 of a sheet 150 having a higher trajectory contacts upper strike facing 258 and/or a leading edge of a sheet having a lower trajectory contacts lower strike facing 268 following exit from the printer or other device.

Figure 1A:
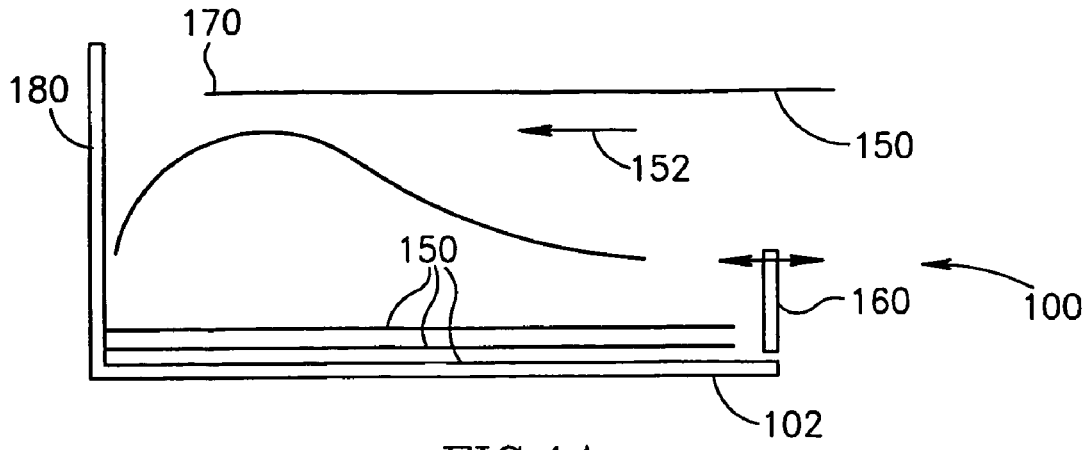
FIG.1A PRIOR ART
FIGS. 1A and 1B are schematic side views of a exit section of a printer having a prior art strike plate.

As leading edge 170 contacts strike facing 258 or 268, the downward movement of edge 170 that is guided by the strike plate (as in FIG. 1A) causing downward curling in the sheet is limited. The downward curl of edge 150 is limited by the small vertical extent of strike facings 258 and 268, limiting the surface against which edge 170 can travel.

Additionally, strike face 268 (for example) comprises an upper edge surface 254. In an exemplary embodiment, surface 254 between adjacent strike steps 256 and 266, connects a lower edge 270 of upper strike facing 258 with an upper edge 282 of lower strike facing 268. Outward-pointing normal vector 286 is associated with strike step 256, for example.

Figure 1B:
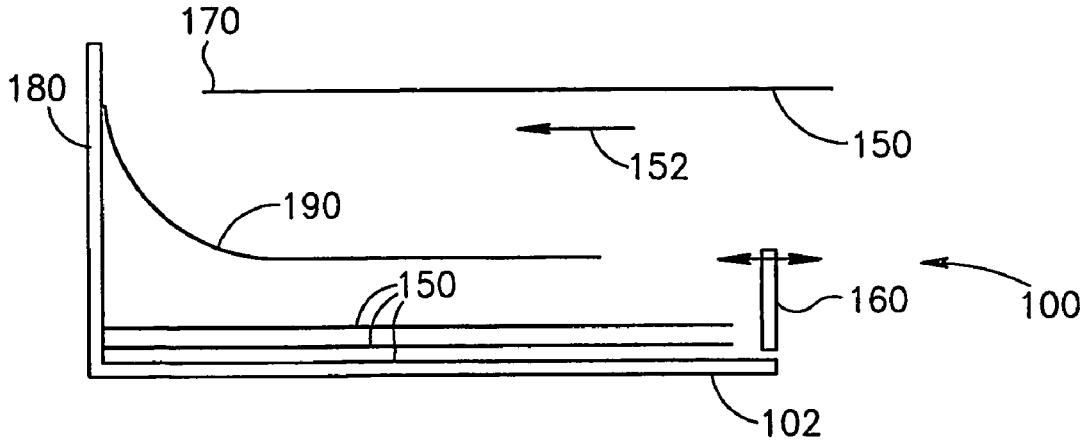
FIG.1B PRIOR ART

As leading edge 170 contacts strike facing 268, any tendency to upward movement of edge 170 (as in FIG. 1B) is limited since edge 170 contacts surface 254 as the sheet begins to curl upward, thereby preventing further upward curl. Outward-pointing normal vector 284 is associated with surface 254, for example.

Thus, each of surfaces 254, 264, etc. act to reduce upward curl for the strike facing below and to reduce downward curl for the strike facing above.

Figure 4:
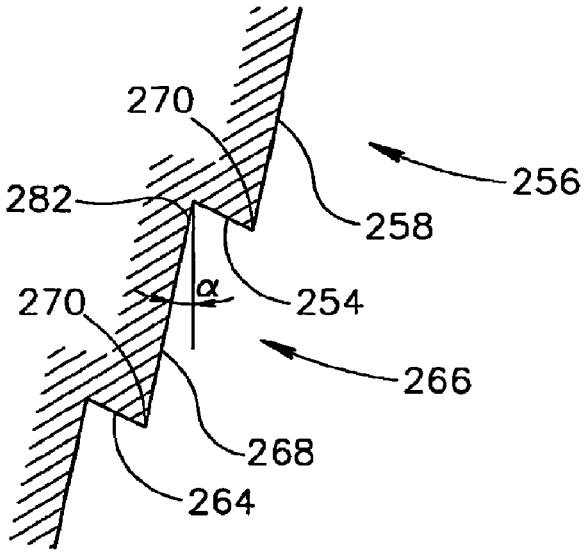
FIG. 4 is an enlarged schematic cross-sectional side view of a portion of the strike plate of FIG. 2; rotated to present strike faces at an angle to the vertical, according to an exemplary embodiment of the present invention.

The present inventors have found that for very light substrate materials, which lack stiffness, have a stronger tendency to curl upward, such that, even with an upper surface for the strike step, fold-over or other undesirable results can result. The inventors have further found that when the angle of the strike face forms an acute angle, "$\alpha$" with the vertical as shown in FIG. 4, this tendency is counteracted. An angle of 10 degrees has been found to work well with most substrate materials, although this angle may not be optimum and may depend on the substrates used. However, in some embodiments of the invention, it may be desirable to vary the angle, optionally depending on the substrate material used. This can be accomplished most simply by rotating the body of the strike plate and thus the angle of the strike face. Angles of between −5 and 15 degrees may be suitable for some situations, with 0-15 or 5-15 being of more general utility. While no particular means is shown, suitable mechanisms for rotating the strike plate by a desired amount can be used.

As used herein, a positive angle with the vertical is one formed by a clockwise rotation of a vertical surface about a horizontal line, for the view direction of the Figs. More generally, the rotation is such that a normal to strike face is downward rotated.

In the embodiment shown, the strike "plate" is actually an edge of a cylinder. Since only a small portion of the cylinder is functional, a smaller portion of the cylinder may be used. It is convenient to use a cylinder, since this shape is easy to manufacture, however, functionally, it is not necessary. Furthermore, while a cylinder having a diameter of 20-30 mm has been found to be suitable, other diameters can be used. In a particular embodiment, a diameter of 24 mm operated satisfactorily. In some embodiments of the invention, a planar surface is provided, rather than a curved surface as indicated. For ease of manufacture, the upper and lower edges may radial surfaces, such that they are perpendicular to the strike faces. However, the angle of the upper and lower edge surfaces is not critical. A non-radial surface is shown, for example, in the Figs.

In an embodiment of the invention, tray 102 is capable of movement upward and downward, such that as the tray fills, the receiving surface remain the same. In an embodiment of the invention an alignment stop 280 (which may be only 10 mm wide) is provided beneath strike plate 200. Stop 280 mates with a cut-out portion of tray 102 and is optionally fixed in height with respect to strike plate 200. As tray 102 rises and is lowered, the alignment stop slides within the cut-out portion. Optionally, stop 280 is rotatable in the direction of the arrow, as indicated, so that the sheets may be easily removed from the direction of its leading edge.

Strike plate 260 can be made of any suitable materials such as aluminum or an other metal. Preferably, the aluminum is hard anodized and optionally Teflon impregnated.

In an exemplary embodiment, strike step 256 has a vertical extent of five millimeters. However, it may have a vertical extent of more than or less than five millimeters, for example based upon the thickness of sheets 250 used in printer 100.

In an exemplary embodiment, surface 254 has a horizontal extent of 3-5 mm. This allows it to fall down without problems. However, it may have a horizontal extent of more than 5 mm, or less than 3 mm, for example based upon the flexibility of sheets 250 used in printer 100, the distance between the strike point and the tope of the pile of sheets and sheet velocity. Further, the vertical extents of edge surfaces 254 and 264 may exhibit a 1:1 ratio with the horizontal extents of strike facings 258 and 268. Alternatively or additionally, the ratio may be higher or lower depending on the speed and/or print media used in the printer.

Figure 5:
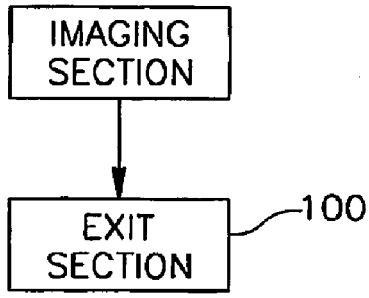
FIG. 5 is a very schematic flow chart of a system in which a page is printed and transferred to an exit section, in accordance with an exemplary embodiment of the invention.

In an exemplary embodiment of the invention, the exit section of the invention is part of a printer of other paper feeding/stacking device. A very schematic flow diagram of such a combination is shown in FIG. 5.

Figure 6:
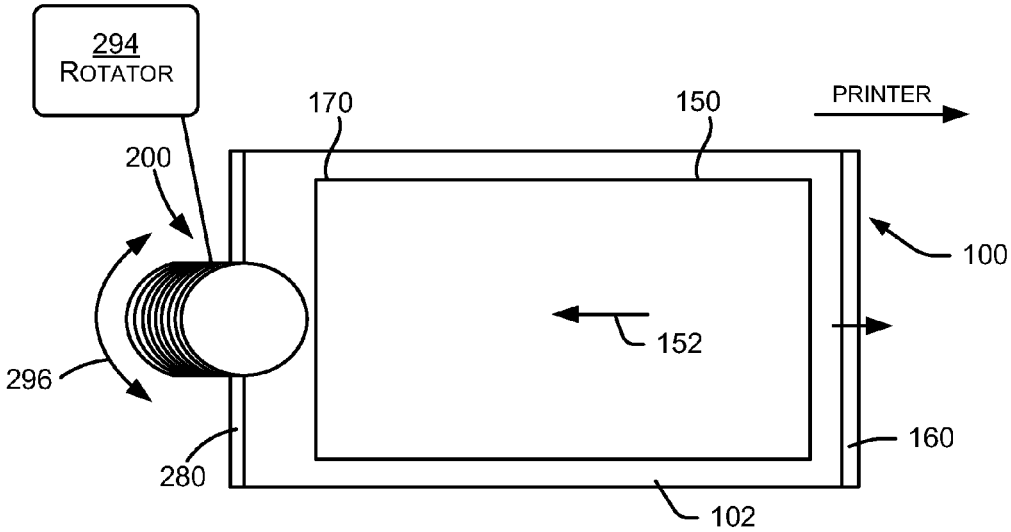
FIG. 6 is a schematic top view of an exit section of a printer comprising a strike plate having multiple strike steps, according to an exemplary embodiment of the present invention.

FIG. 6 is a schematic top view of an exit section of a printer comprising a strike plate having multiple strike steps. In an exemplary embodiment of the invention, the strike plate is the surface of a cylindrical portion of an object, and the cylindrical object is rotated about the axis of the cylindrical portion with respect to the vertical. This rotation is shown as element 296 in FIG. 6.

In an exemplary embodiment of the invention, rotator 294 of FIG. 6 is operative to rotate the strike face so as to allow for a different angle with respect to the vertical, depending on the characteristics of the sheet used. This rotation of the strike plate is also shown in FIG. 2 as element 292.

Although this description and the claims refer to paper, the invention may also be used with any other printing media, and the claims cover the apparatus and the method when any printing media is used. Additionally, this invention may be used with any printing device, whether a copy machine, printer or facsimile, that produces printed sheets seriatim.

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art.

Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the invention and which are described as examples. For example, details of the tray and internal alignment mechanisms for the sheets after they fall into the tray, may not be present or may be replaced by other mechanisms. Structure and acts described herein are replaceable by equivalents, which perform the same function, even if the structure or acts are different, as known in the art. Therefore, only the elements and limitations as used in the claims limit the scope of the invention.

The invention claimed is:

1. A strike plate against which sheets exiting a printer contact prior to falling into a receiving tray, the strike plate comprising:

at least one strike face, wherein the strike face is at an angle of between +5 and +15 degrees with the vertical, where a positive angle denotes that the outward-pointing normal to the strike face is rotated downward with respect to the horizontal; and a single connecting surface associated with each of the at least one strike face, wherein the single connecting surface connects the strike face with the strike plate and intersects with the lower terminus of the strike face to form an acute angle in the interior of the strike plate, and wherein the outward-pointing normal of the single connecting surface is directed in a downward direction.

2. A strike face according to claim 1 wherein the strike face is at an angle of about +10 degrees.

3. A strike plate according to claim 1 including a plurality of strike faces that are offset from each other in the direction of motion of the sheet.

4. A strike plate against which sheets exiting a printer contact prior to falling into a receiving tray, the strike plate comprising:

a plurality of strike faces that are offset from each other in the direction of motion of the sheet, wherein each of the plurality of strike faces are at an angle of between −5 and +15 degrees with the vertical, where a positive angle denotes that the outward-pointing normal to the strike face is rotated downward with respect to the horizontal; and wherein each of the plurality of strike faces has an associated single connecting surface, wherein the single connecting surface connects the associated strike face with the strike plate and intersects with the lower terminus of the associated strike face to form an acute angle in the interior of the strike plate, and wherein the outward-pointing normal of the single connecting surface is directed in a downward direction; and including a rotator, operative to rotate the strike face so as to allow for a different angle with respect to the vertical, depending on the characteristics of the sheet used.

5. A strike plate according to claim 4 wherein a connecting surface associated with one strike face intersects with the upper terminus of a next lower strike face.

6. An exit section of a paper handling system comprising an exit receptacle and a strike plate according to claim 4.

7. A paper handling system comprising an exit section according to claim 6.

8. An imager comprising:

an imaging section; and an exit section according to claim 6.

9. An imager according to claim 8 wherein the imaging section is a printer.

10. An imager according to claim 8 wherein the imaging section is a copier.

11. A strike plate according to claim 1 and including a rotator, operative to rotate the strike face so as to allow for a different angle with respect to the vertical, depending on the characteristics of the sheet used.

12. A strike plate according to claim 1 wherein the strike plate is the surface of a cylindrical portion of an object.

13. A strike plate according to claim 12 wherein the cylindrical object is rotated about the axis of the cylindrical portion with respect to the vertical.

14. A strike plate according to claim 13 wherein the cylindrical portion has a diameter of between 20 and 30 mm.

15. A strike plate according to claim 14 wherein the cylindrical portion has a diameter of about 24 mm.

16. An exit section of a paper handling system comprising an exit receptacle and a strike plate according to claim 1.

17. A paper handling system comprising an exit section according to claim 16.

18. An imager comprising:

an imaging section; and an exit section according to claim 16.

19. An imager according to claim 18 wherein the imaging section is a printer.

20. An imager according to claim 18 wherein the imaging section is a copier.

21. A strike plate against which sheets exiting a printer contact prior to falling into a receiving tray, the strike plate comprising:

a plurality of strike faces that are offset from each other in a direction of motion of the exiting sheets, wherein each of the plurality of strike faces is at an angle of between −5 and +15 degrees with the vertical, where a positive angle denotes that an outward-pointing normal to the strike face is rotated downward with respect to horizontal;

wherein each of the plurality of strike faces has an associated single connecting surface, wherein the single connecting surface connects the associated strike face with the strike plate and intersects with a lower terminus of the associated strike face to form an acute angle in the interior of the strike plate, and wherein an outward-pointing normal of the single connecting surface is directed in a downward direction;

wherein the plurality of strike plates is the surface of a cylindrical portion of an object; and wherein the cylindrical object is rotated about an axis of the cylindrical portion with respect to vertical.

* * * * *